US009421597B2

(12) United States Patent
Yamamoto et al.

(10) Patent No.: US 9,421,597 B2
(45) Date of Patent: Aug. 23, 2016

(54) PRESS-WORK METHOD AND BOTTOMED CONTAINER

(71) Applicant: NIPPON STEEL & SUMITOMO METAL CORPORATION, Tokyo (JP)

(72) Inventors: Shuji Yamamoto, Tokyo (JP); Yasuhiro Wada, Tokyo (JP); Mitsuharu Yamagata, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/427,173

(22) PCT Filed: Oct. 22, 2013

(86) PCT No.: PCT/JP2013/078611
§ 371 (c)(1),
(2) Date: Mar. 10, 2015

(87) PCT Pub. No.: WO2014/065290
PCT Pub. Date: May 1, 2014

(65) Prior Publication Data

US 2015/0239029 A1 Aug. 27, 2015

(30) Foreign Application Priority Data

Oct. 23, 2012 (JP) ..... 2012-233707

(51) Int. Cl.
*B21D 22/20* (2006.01)
*B21K 21/16* (2006.01)
(Continued)

(52) U.S. Cl.
CPC ..... *B21D 22/20* (2013.01); *B21D 22/21* (2013.01); *B21D 24/04* (2013.01); *B21D 51/02* (2013.01); *B21D 51/26* (2013.01); *B21J 5/08* (2013.01); *B21K 21/16* (2013.01)

(58) Field of Classification Search
CPC ..... B21D 22/20; B21D 22/21; B21D 22/26; B21D 22/28; B21D 51/02; B21D 51/26; B21D 24/04; B21J 5/08; B21K 21/16
See application file for complete search history.

(56) References Cited

FOREIGN PATENT DOCUMENTS

JP 2000024745 A * 1/2000
JP 2001-47175 A 2/2001
(Continued)

OTHER PUBLICATIONS

"Automotive Engineering", Automotive Engineers of Japan Inc., 1996, vol. 50, No. 12, pp. 31-37.
(Continued)

*Primary Examiner* — Debra Sullivan
(74) *Attorney, Agent, or Firm* — Birch, Stewart, Kolasch & Birch, LLP

(57) ABSTRACT

A press mold includes an inner punch (23), an intermediate punch (24) disposed along an outer periphery of the inner punch (23) and having an intermediate punch inclined portion (24*a*) at a leading end, an outer punch (25) disposed along an outer periphery of the intermediate punch (24), and a die (27) having a die inclined portion (27*a*) facing the intermediate punch inclined portion (24*a*), central axes (20) of all of which are coaxially disposed. While a bottom portion of a bottomed container (22) is constrained by the inner punch (23) and the die (27), an end portion of the bottomed container (22) is pressed by the outer punch (25), and the intermediate punch (24) is moved in a direction opposite a direction in which the outer punch (25) is pressed, whereby a bottomed container inclined portion (22*a*) of the bottomed container (22) sandwiched by the intermediate punch inclined portion (24*a*) and the die inclined portion (27*a*) is thickened.

4 Claims, 12 Drawing Sheets

(51) Int. Cl.

| | |
|---|---|
| ***B21J 5/08*** | (2006.01) |
| ***B21D 22/21*** | (2006.01) |
| ***B21D 24/04*** | (2006.01) |
| ***B21D 51/02*** | (2006.01) |
| ***B21D 51/26*** | (2006.01) |

(56) References Cited

FOREIGN PATENT DOCUMENTS

| | | | |
|---|---|---|---|
| JP | 2005-349433 | A | 12/2005 |
| JP | 2009-248092 | A | 10/2009 |
| JP | 2010-120058 | A | 6/2010 |
| JP | 2010-214381 | A | 9/2010 |
| JP | 2010-247199 | A | 11/2010 |

OTHER PUBLICATIONS

International Search Report, issued in PCT/JP2013/078611, dated Jan. 21, 2014.
Written Opinion of the International Searching Authority, issued in PCT/JP2013/078611, dated Jan. 21, 2014.
International Preliminary Report on Patentability and English translation of the Written Opinion of the International Searching Authority (Forms PCT/IB/338, PCT/IB/373 and PCT/ISA/237), dated May 7, 2015, for International Application No. PCT/JP2013/078611.

* cited by examiner

PRESS-WORK METHOD AND BOTTOMED CONTAINER

TECHNICAL FIELD

The present invention relates to a press-work method of thickening an inclined portion rising from a bottom surface portion of a bottomed container, and to a bottomed container manufactured by the same.

BACKGROUND ART

With reference to FIG. 1A and FIG. 1B, as a method of thickening a vertical wall of a bottomed container, a method in which a disk-shaped workpiece is formed into a bottomed container 11 by deep drawing, and an end surface 11*b* of the bottomed container is pushed by a pushing punch 14 while a bottomed container bottom surface 11*a* is sandwiched by a die 12 and a pressing punch 13, to thereby thicken a vertical wall 11*c* of the bottomed container has been conventionally in general use. In this method, however, being constrained only weakly, the vertical wall portion of the bottomed container buckles during the thickening, so that folding 11*d* occurs. This has made it difficult to realize a large thickening ratio (sheet thickness after the thickening/original sheet thickness) exceeding 1.3.

For example, Patent Literature 1 discloses a thickening press-work method in which a pressing punch and an upsetting punch are provided, and between an upper end portion and a bottom inner portion of a workpiece, a gap is reserved between the pressing punch and a die, and an upper surface of the end portion of the workpiece is pressed by the upsetting punch. However, in the method of Patent Literature 1, folding may also occur because buckling occurs in the gap during the thickening.

Therefore, there has been proposed a method to overcome the drawbacks of the above-described thickening methods, in the manufacture of a pulley piston for continuously variable transmission of an automobile, as described in Non Patent Literature 1. This forming method is capable of preventing folding ascribable to buckling because a portion to be thickened is thickened by pushing an end portion of a cup in a state where a constraint surface of a material is increased by providing a corner portion in the portion to be thickened. However, since a gap of the portion to be thickened is geometrically decided by constraint by the shape of a mold and the movement of the mold, a maximum thickening ratio that can be achieved in one forming is about 1.5. Further, before this process, it is necessary to form a bottomed cylindrical container by deep drawing or the like, and totally two processes are required.

Further, Patent Literature 2 proposes a method in which a press-worked workpiece which has an end wall, a bent portion bent from an outer periphery of the end wall toward one side, and a cylindrical portion provided to continue from the bent portion is used, the workpiece is clamped by a clamp punch adapted to an inner surface of the workpiece, a clamp die adapted to an outer surface of the end wall, and a thickness-increase guide die fitted to an outer peripheral surface of the clamp die so as to be swingable in an axial direction and adapted to outer peripheral surfaces of the bent portion and the cylindrical portion, a thickness-increasing punch is inserted in space formed between the clamp punch and the thickness-increase guide die to apply an axial-direction compression load to the cylindrical portion, thereby thickening the bent portion, and the thickness-increase guide die is retracted from the clamp die according to the thickening.

Further, Patent Literature 3 proposes a structure in which a knockout for receiving a body portion of a workpiece, a plate presser for pressing an area up to the middle of a rising portion rising obliquely outward from the body portion, a thickness-increasing punch for pressing a tip of the rising portion, and a die for receiving the rising portion are provided, and the die is movable in an axial direction relatively to the knockout and the thickness-increasing punch. In the process of crushing the rising portion by pressing the tip of the rising portion by the thickness-increasing punch, the die is pressed by the rising portion which is in the course of being thickened without being pushed by the thickness-increasing punch, to move relatively to the knockout, so that a gap between the plate presser and the die which sandwich the rising portion widens.

However, the methods of Patent Literatures 2, 3 also require the forming of a bottomed cylindrical container by deep drawing or the like, and thus require totally two processes. Further, a cutting process is sometimes required because a large step occurs in a boundary between a thickened portion and a non-thickened portion. Further, an achievable thickening ratio is not mentioned.

Further, in the structure in which the die is divided and part thereof is moved, in Patent Literature 2, for example, a force in a direction perpendicular to an inclined portion (2*b* in Patent Literature 2) acts on the thickness-increase guide die at the time of the thickening. Since this force acts in such a direction as to make the thickness-increase guide die separate from the clamp die (outward in a diameter direction), a gap occurs in a boundary between the clamp die and the thickness-increase guide die, which may cause a burr.

CITATION LIST

Patent Literature

Patent Literature 1: Japanese Laid-open Patent Publication No. 2001-47175

Patent Literature 2: Japanese Laid-open Patent Publication No. 2010-247199

Patent Literature 3: Japanese Laid-open Patent Publication No. 2009-248092

Non-Patent Literature

Non Patent Literature 1: "Automotive Engineering", Automotive Engineers of Japan Inc., 1996, Vol. 50, No 12, p. 31-37

SUMMARY OF INVENTION

Technical Problem

The present invention was made in order to solve the above-described conventional drawbacks and its main object is to make it possible to avoid folding due to buckling to achieve thickening with a thickening ratio of 1.5 times or more in a press-work. Its another object is to make it possible to manufacture a bottomed container having a smooth shape without a large step in a boundary between a thickened portion and a non-thickened portion. Its another object is to make it possible to manufacture a bottomed container whose inclined portion is thickened, from a disk-shaped workpiece by a press-work having one process.

Solution to Problem

The gist of the present invention that is to achieve the aforesaid objects is as follows.

[1] A press-work method using a press mold which includes an inner punch, an intermediate punch disposed along an outer periphery of the inner punch and having an intermediate punch inclined portion at a leading end, an outer punch disposed along an outer periphery of the intermediate punch, and a die having a die inclined portion facing the intermediate punch inclined portion, central axes of all of which are disposed coaxially, the method including a thickening step of, while constraining a bottom portion of a bottomed container by the inner punch and the die, pressing an end portion of the bottomed container by the outer punch and moving the intermediate punch in a direction opposite a direction in which the outer punch is pressed, to thereby thicken a bottomed container inclined portion of the bottomed container sandwiched by the intermediate punch inclined portion and the die inclined portion.

[2] A press-work method using a press mold which includes an inner punch having an inner punch flat portion and an inner punch inclined portion at a leading end, an intermediate punch disposed along an outer periphery of the inner punch and having an intermediate punch inclined portion at a leading end, an outer punch disposed along an outer periphery of the intermediate punch, and a die having a die inclined portion disposed to face the intermediate punch inclined portion, central axes of all of which are disposed coaxially, the inner punch inclined portion being formed at an end portion, of the leading end of the inner punch, on a side adjacent to the intermediate punch inclined portion, the method including:

an outer punch pressing step of, while constraining a bottom portion of a bottomed container by the inner punch flat portion and the die, pressing an end portion of the bottomed container by the outer punch to thereby bring a bottomed container inclined portion, of the bottomed container, which extends along the inner punch inclined portion and the intermediate punch inclined portion, into contact with the die inclined portion;

an intermediate punch pressing step of pressing the intermediate punch in a direction of the die against the bottomed container which is brought into contact with the die inclined portion in the outer punch pressing step, to bring the intermediate punch inclined portion into contact with the bottomed container inclined portion; and a thickening step of pressing the outer punch against the bottomed container which is brought into contact with the intermediate punch inclined portion in the intermediate punch pressing step, and moving the intermediate punch in a direction opposite a direction in which the outer punch is pressed, to thereby thicken the bottomed container inclined portion.

[3] The press-work method according to [1], including, before the thickening step, a forming step of pressing a disk-shaped workpiece into the die by the inner punch and the intermediate punch to form the bottomed container in which the bottomed container inclined portion is formed at a position sandwiched by the intermediate punch inclined portion and the die inclined portion.

[4] The press-work method according to [2], including, before the outer punch pressing step, a forming step of pressing a disk-shaped workpiece into the die by the inner punch and the intermediate punch to form the bottomed container in which the bottomed container inclined portion is formed at a position sandwiched by the inner punch inclined portion and the intermediate punch inclined portion, and the die inclined portion.

[5] The bottomed container manufactured by the press-work method according to [1], wherein a thickening ratio of a thickness of the bottomed container inclined portion is 1.5 times or more.

[6] The bottomed container manufactured by the press-work method according to [2], wherein a thickening ratio of a thickness of the bottomed container inclined portion is 1.5 times or more.

Advantageous Effects of Invention

According to the present invention, it is possible to avoid folding due to buckling to achieve thickening with a thickening ratio of 1.5 times or more.

Further, it is possible to manufacture a bottomed container having a smooth shape without a large step in a boundary between a thickened portion and a non-thickened portion.

Furthermore, it is possible to manufacture a bottomed container whose inclined portion is thickened, from a disk-shaped workpiece by a press-work having one process.

DESCRIPTION OF EMBODIMENTS

Hereinafter, modes for carrying out the present invention will be described with reference to the attached drawings.

As a result of studious studies, the present inventor has found out that, by performing deep drawing by using an inner punch, an intermediate punch disposed along an outer periphery of the inner punch, and a die, central axes of all of which are coaxially disposed, to form a bottomed container, and subsequently, while constraining a workpiece, performing thickening by gradually increasing a gap between the intermediate punch and the die when an end surface of the bottomed container is pressed by the outer punch, it is possible to perform the thickening with a thickening ratio of 1.5 times or more by a press-work having one process while avoiding folding due to buckling.

(First Embodiment)

Figure 1A:
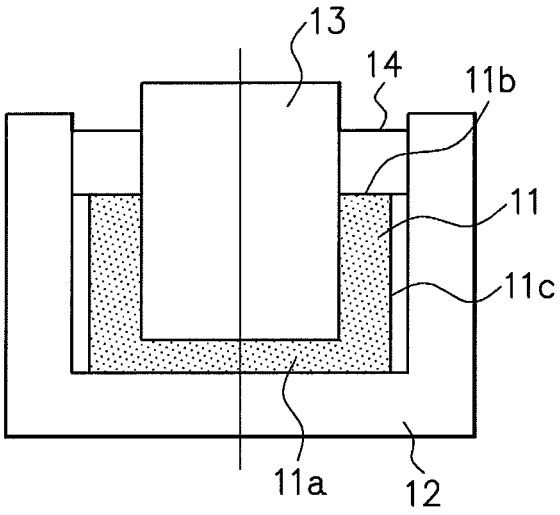
CONVENTIONAL ART F I G. 1A
FIG. 1A is a cross-sectional view illustrating a conventional thickening work.
Figure 1B:
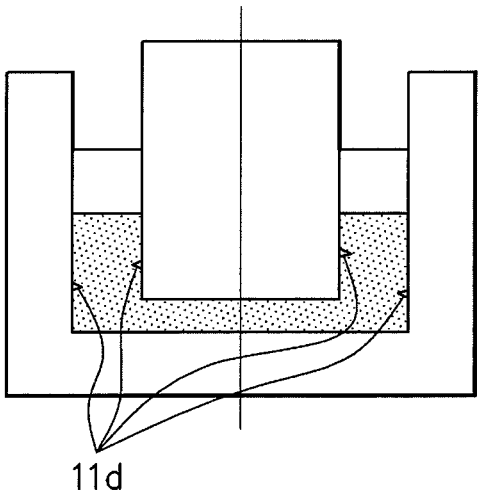
CONVENTIONAL ART F I G. 1B
FIG. 1B is a cross-sectional view illustrating the conventional thickening work.
Figure 2:
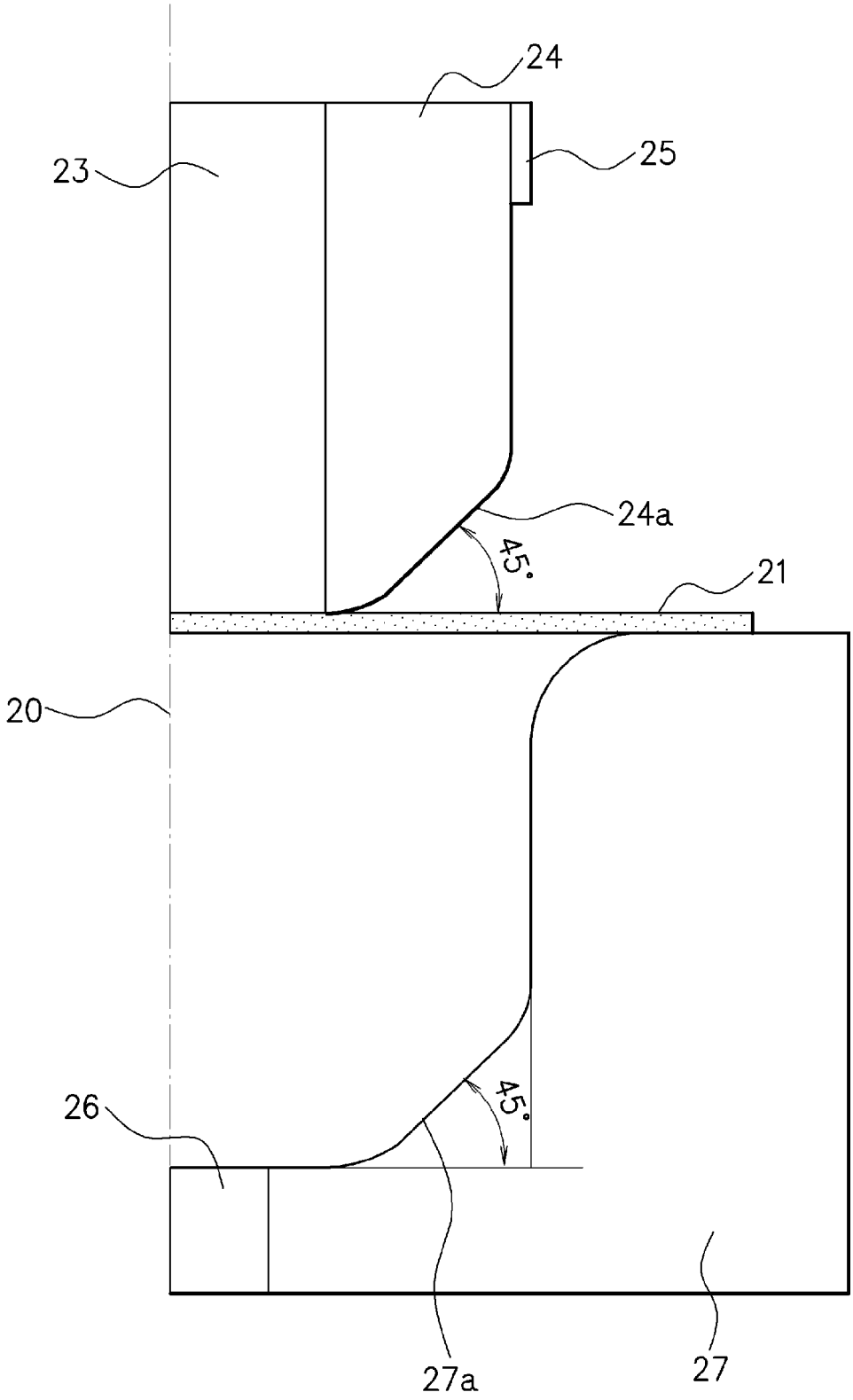
FIG. 2 is a cross-sectional view illustrating a state before deep drawing in a press-work method according to a first embodiment.

FIG. 2 is a cross-sectional view illustrating a state before deep drawing is executed. As illustrated in FIG. 2, a press mold includes an inner punch 23, an intermediate punch 24 disposed along an outer periphery of the inner punch 23, an outer punch 25 disposed along an outer periphery of the intermediate punch 24, a knockout 26, and a die 27 disposed along an outer periphery of the knockout 26, central axes of all of which are coaxially disposed. The inner punch 23 is disposed to face the knockout 26 and the die 27, and the intermediate punch 24 and the outer punch 25 are disposed to face the die 27.

The inner punch 23 has a columnar shape, and is of a movable type capable of moving up and down by a not-illustrated drive source of a mechanical type (hydraulic or servo motor, or the like).

The intermediate punch 24 has a cylindrical shape, and on its surface that comes into contact with a portion to be thickened of a workpiece (that is, on a lower end portion (leading end) of the intermediate punch 24), an intermediate punch inclined portion 24*a* is formed. This intermediate punch inclined portion 24*a* is inclined in an obliquely upward direction from an inner punch 23 side toward an outer punch 25 side. The intermediate punch 24 is of a movable type capable of moving up and down by a not-illustrated mechanical drive source.

The outer punch 25 has a cylindrical shape and is of a movable type capable of moving up and down by a not-illustrated mechanical drive source.

The knockout 26 has a columnar shape, is intended to detach a formed product from the mold, and is of a movable type capable of moving up and down by a not-illustrated mechanical drive source.

The die 27 is of a fixed type, has a substantially concave shape, and has, at a center portion, a hole allowing the knockout 26 to be inserted therein. Further, in the die 27, a die inclined portion 27*a* is formed, and this die inclined portion 27*a* is disposed to face the intermediate punch inclined portion 24*a*.

In this embodiment, by executing the following forming step and thickening step, the workpiece 21 was press-worked. As the workpiece 21, a disk-shaped high-tensile steel sheet (SAPH590) having a 240 mm outside diameter and a 4 mm sheet thickness was used.

Figure 3:
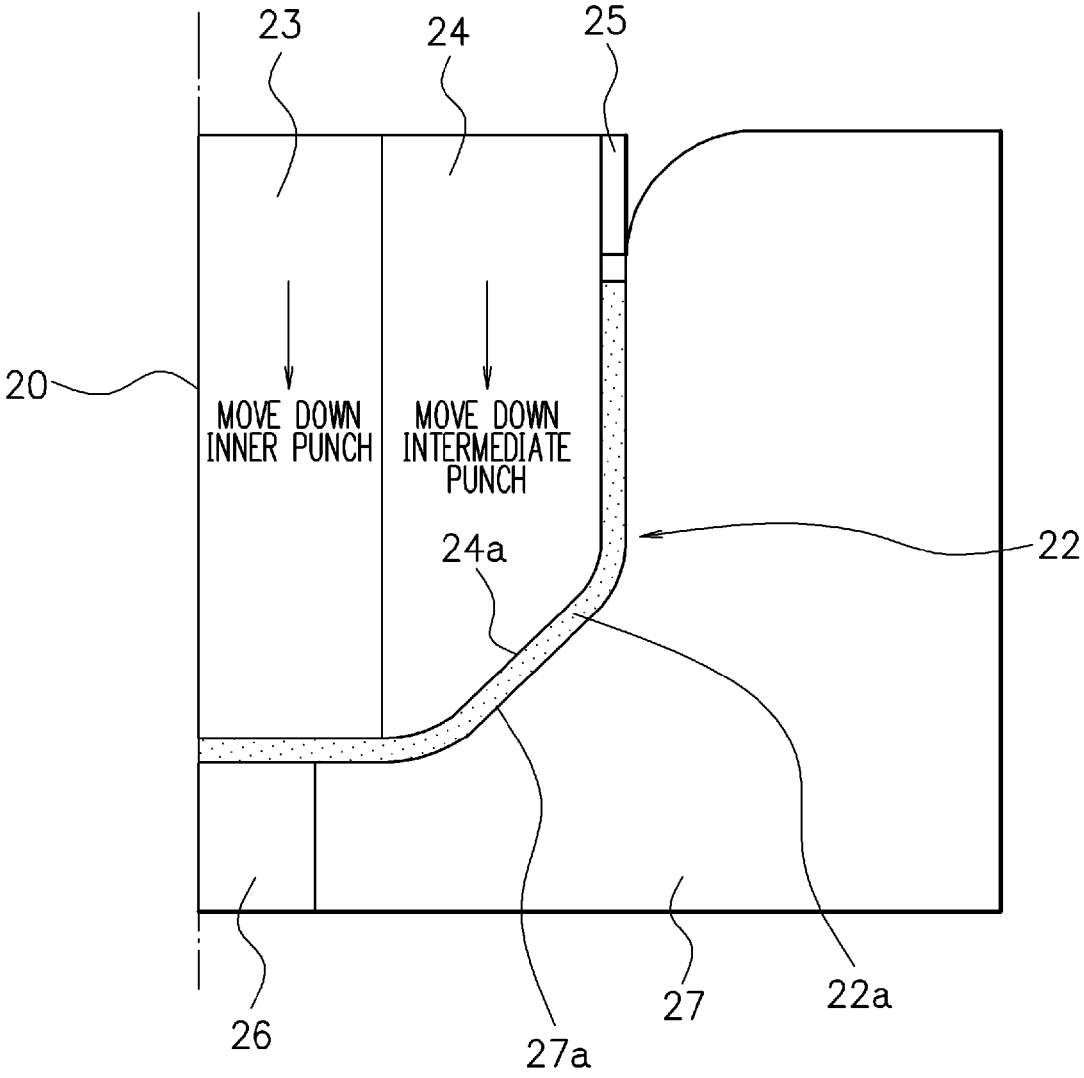
FIG. 3 is a cross-sectional view illustrating a state after the deep drawing in the press-work method according to the first embodiment.

The workpiece 21 is placed on the die 27 and is subjected to the deep drawing by pressing the inner punch 23 and the intermediate punch 24, whereby a bottomed container 22 in which a bottomed container inclined portion 22*a* is formed at a position sandwiched by the intermediate punch inclined portion 24*a* and the die inclined portion 27*a* is formed as illustrated in FIG. 3 (forming step).

In the state illustrated in FIG. 3, a bottom portion of the bottomed container 22 is constrained by the inner punch 23 and the die 27.

Figure 4:
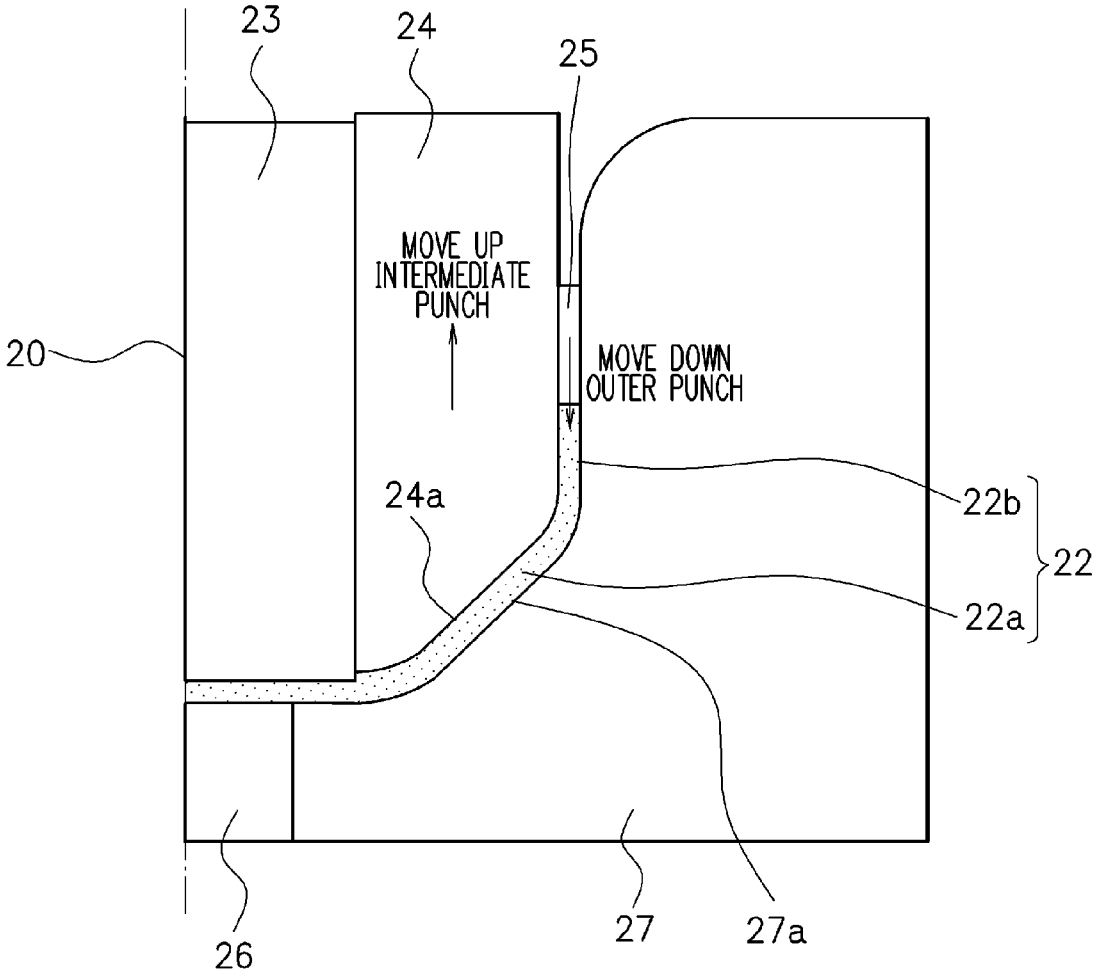
FIG. 4 is a cross-sectional view illustrating a state in the middle of thickening in the press-work method according to the first embodiment.
Figure 5:
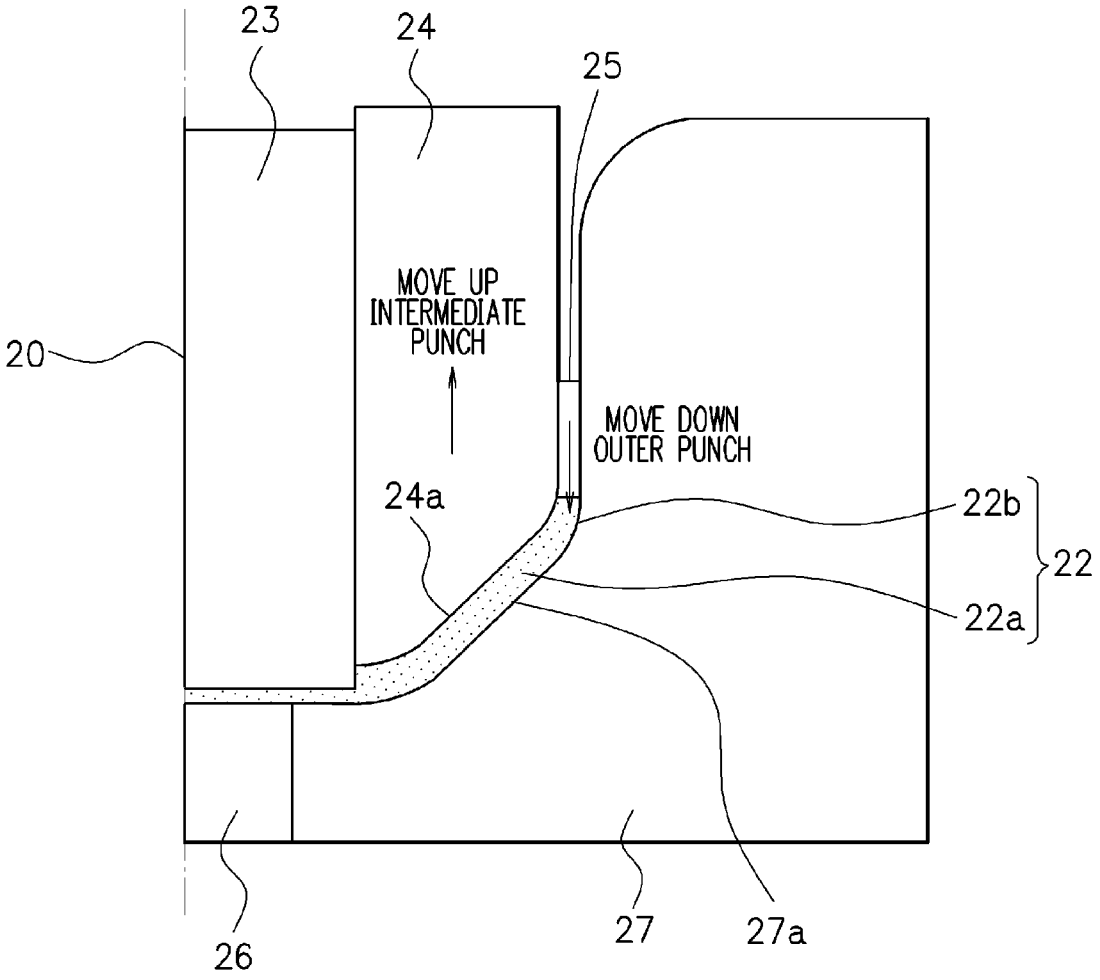
FIG. 5 is a cross-sectional view illustrating a state after the thickening in the press-work method according to the first embodiment.

Subsequently, as illustrated in FIG. 4 and FIG. 5, an end surface of the bottomed container 22 formed in the forming step is pressed by the outer punch 25, and the intermediate punch 24 is moved upward. Consequently, a gap between the intermediate punch inclined portion 24*a* and the die inclined portion 27*a* gradually becomes larger, which makes it possible to perform the thickening while suppressing buckling by sandwiching the bottomed container inclined portion 22*a* by the intermediate punch inclined portion 24*a* and the die inclined portion 27*a* (thickening step). The cross-sectional views in FIG. 4 and FIG. 5 illustrate states in the middle of the thickening and after the thickening respectively.

After the thickening step, the inner punch 23, the intermediate punch 24, the outer punch 25, and the knockout 26 are moved upward, and the bottomed container 22 is detached from the die 27. A sheet thickness of the bottomed container inclined portion 22*a* is 6.9 mm, and thus the thickness can be increased to 1.73 times an original sheet thickness of 4 mm without any occurrence of folding due to buckling.

Further, at the time of the thickening, a force in a direction perpendicular to the intermediate punch inclined portion 24*a* acts on the intermediate punch 24, but since this force acts in such a direction as to press the intermediate punch 24 against the inner punch 23 (inward in a diameter direction (center direction)), there occurs no gap in a boundary between the inner punch 23 and the intermediate punch 24 and a burr is not generated.

(Second Embodiment)

In a second embodiment, a bottomed container having a smooth shape without a large step in a boundary between a thickened portion and a non-thickened portion is manufactured.

Figure 6:
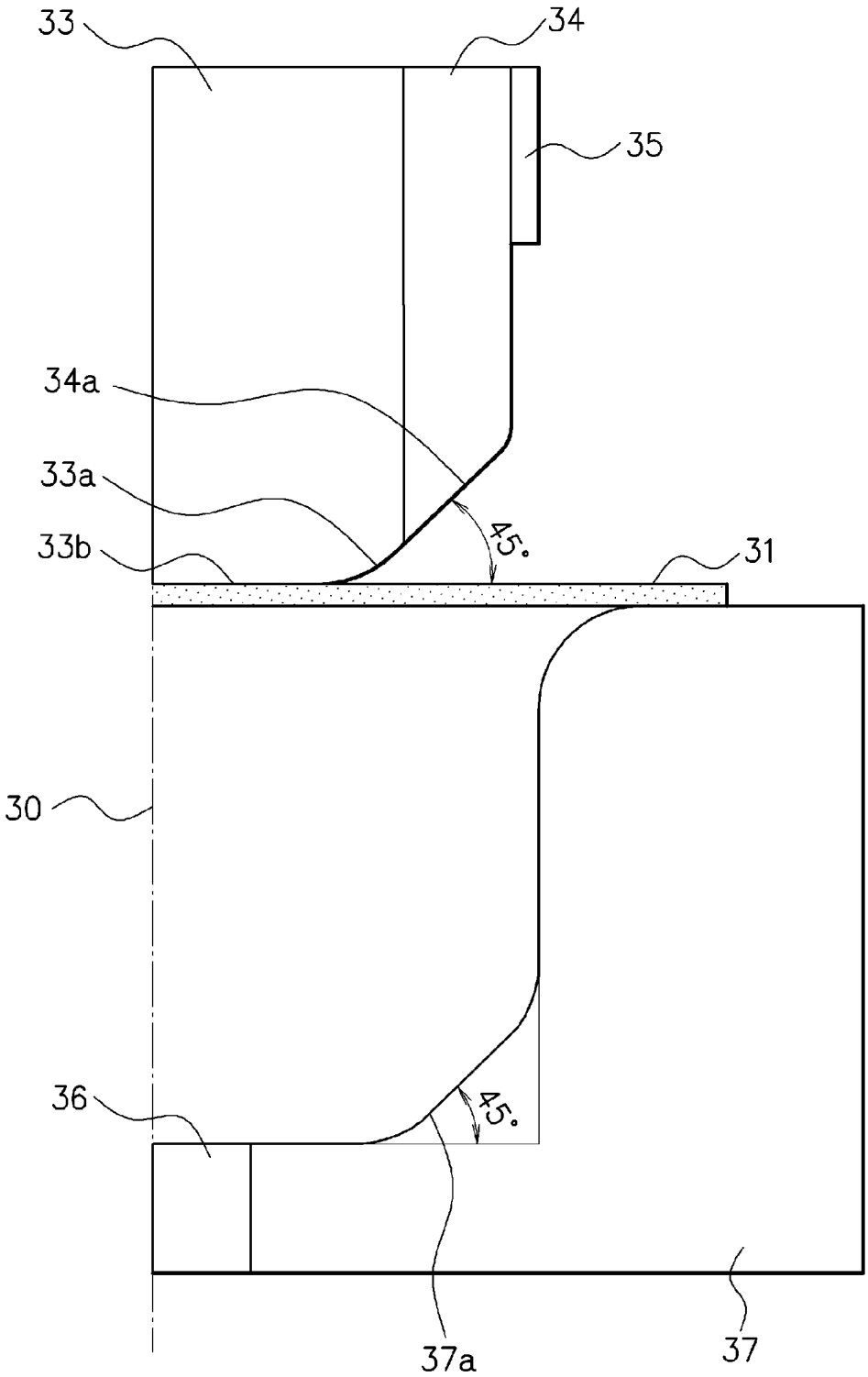
FIG. 6 is a cross-sectional view illustrating a state before deep drawing in a press-work method according to a second embodiment.

FIG. 6 is a cross-sectional view illustrating a state before deep drawing is executed. As illustrated in FIG. 6, a press mold includes an inner punch 33, an intermediate punch 34 disposed along an outer periphery of the inner punch 33, an outer punch 35 disposed along an outer periphery of the intermediate punch 34, a knockout 36, and a die 37 disposed along an outer periphery of the knockout 36, central axes 30 of all of which are coaxially disposed. The inner punch 33 is disposed to face the knockout 36 and the die 37, and the intermediate punch 34 and the outer punch 35 are disposed to face the die 37.

The inner punch 33 has a columnar shape, and on its leading end, an inner punch inclined portion 33*a* and an inner punch flat portion 33*b* are formed. The inner punch inclined portion 33*a* is formed on a peripheral edge portion of the leading end, that is, on an end portion on a side adjacent to an intermediate punch inclined portion 34*a*, and the inner punch flat portion 33*b* is formed around the central axis 30. The inner punch inclined portion 33*a* is inclined in an obliquely upward direction from a central axis 30 side toward an intermediate punch 34 side. The inner punch flat portion 33*b* extends in a horizontal direction perpendicular to the central axis 30. The inner punch 33 is of a movable type capable of moving up and down by a not-illustrated mechanical drive source.

The intermediate punch 34 has a cylindrical shape, and on its surface that comes into contact with a portion to be thickened of a workpiece (that is, on a lower end portion (leading end) of the intermediate punch 34), the intermediate punch inclined portion 34*a* is formed. This intermediate punch inclined portion 34*a* is inclined in an obliquely upward direction from an inner punch 33 side toward an outer punch 35 side. The intermediate punch 34 is of a movable type capable of moving up and down by a not-illustrated mechanical drive source.

Here, when a height of an end portion of the inner punch inclined portion 33*a* on a side more distant from the central axis 30 and a height of an end portion of the intermediate punch inclined portion 34*a* on a side closer to the central axis 30 are equal, that is, in the state illustrate in FIG. 6, the inner punch inclined portion 33*a* and the intermediate punch inclined portion 34*a* form a smooth curve.

The outer punch 35 has a cylindrical shape and is of a movable type capable of moving up and down by a not-illustrated mechanical drive source.

The knockout 36 has a columnar shape, is intended to detach a formed product from the mold, and is of a movable type capable of moving up and down by a not-illustrated mechanical drive source.

The die 37 is of a fixed type, has a substantially concave shape, and has, at a center portion, a hole allowing the knockout 36 to be inserted therein. In the die 37, a die inclined portion 37*a* is formed, and this die inclined portion 37*a* is disposed to face the inner punch inclined portion 33*a* and the intermediate punch inclined portion 34*a*.

In this embodiment, by executing the following forming step, outer punch pressing step, intermediate punch pressing step, and thickening step, the workpiece 31 was press-worked. As the workpiece 31, a disk-shaped high-tensile steel sheet (SAPH590) having a 224 outside diameter and a 4 mm sheet thickness was used.

Figure 7:
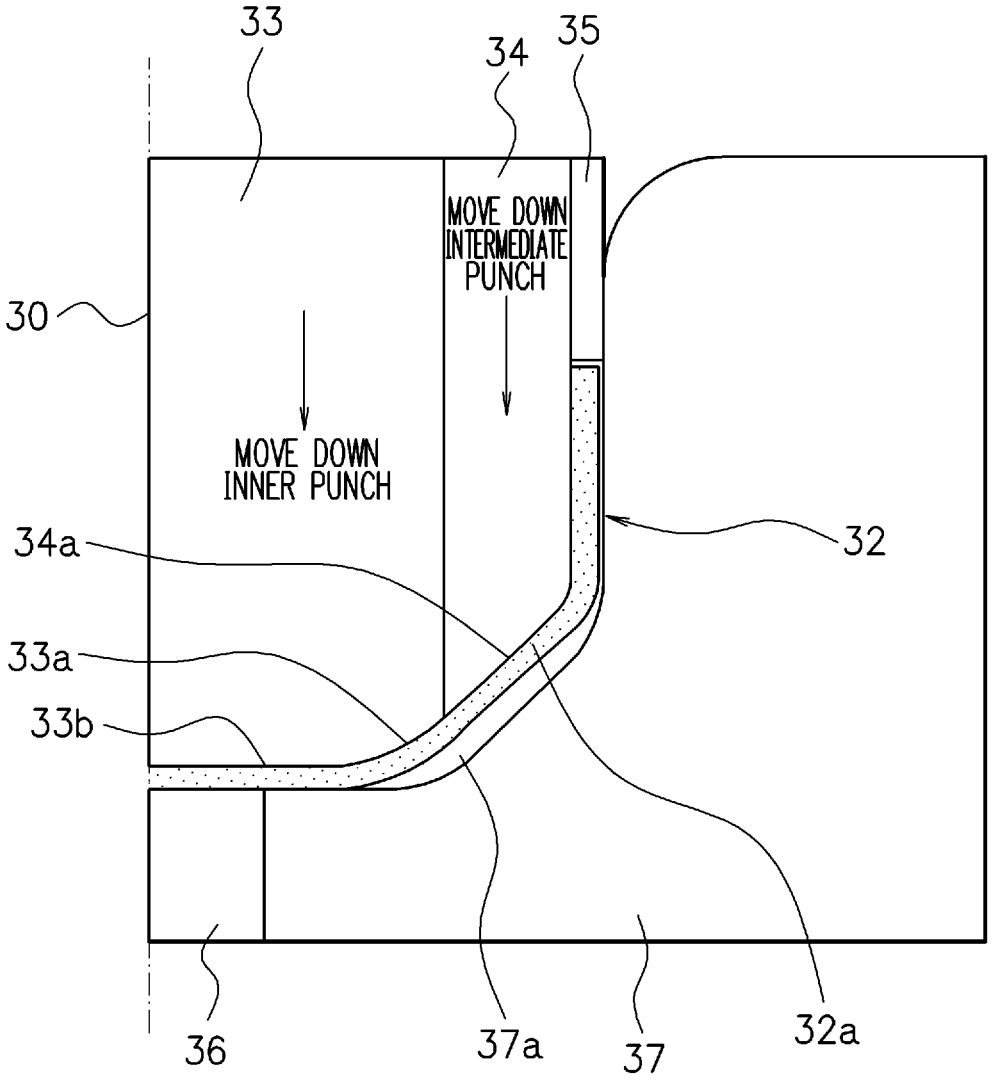
FIG. 7 is a cross-sectional view illustrating a state after the deep drawing in the press-work method according to the second embodiment.

The workpiece 31 is placed on the die 37, and is subjected to the deep drawing by pressing the inner punch 33 and the intermediate punch 34, whereby a bottomed container 32 in which a bottomed container inclined portion 32*a* is formed at a position sandwiched by the inner punch inclined portion 33*a* and the intermediate punch inclined portion 34*a*, and the die inclined portion 37*a* is formed as illustrated in FIG. 7 (forming step).

In the state illustrated in FIG. 7, a bottom portion of the bottomed container 32 is constrained by the inner punch flat portion 33*b* of the inner punch 33 and the die 37.

Figure 8:
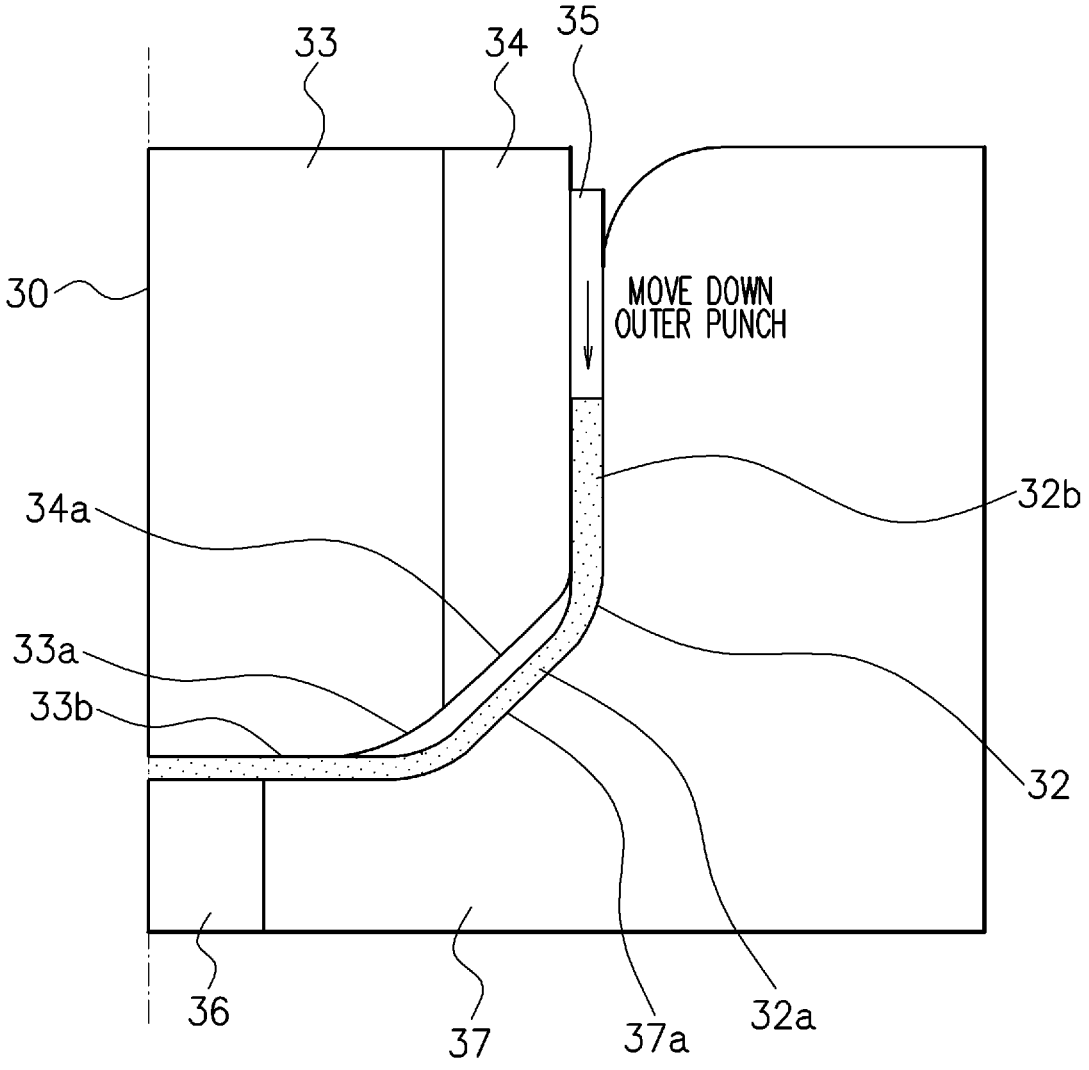
FIG. 8 is a cross-sectional view illustrating a state where an inclined portion of a die is brought into contact with an inclined portion of a bottomed container in the press-work method according to the second embodiment.

Subsequently, an end surface of the bottomed container 32 formed in the forming step is pressed by the outer punch 35, whereby the bottomed container inclined portion 32*a* extending along the inner punch inclined portion 33*a* and the intermediate punch inclined portion 34*a* is brought into contact with the die inclined portion 37*a* as illustrated in FIG. 8 (outer punch pressing step).

Figure 9:
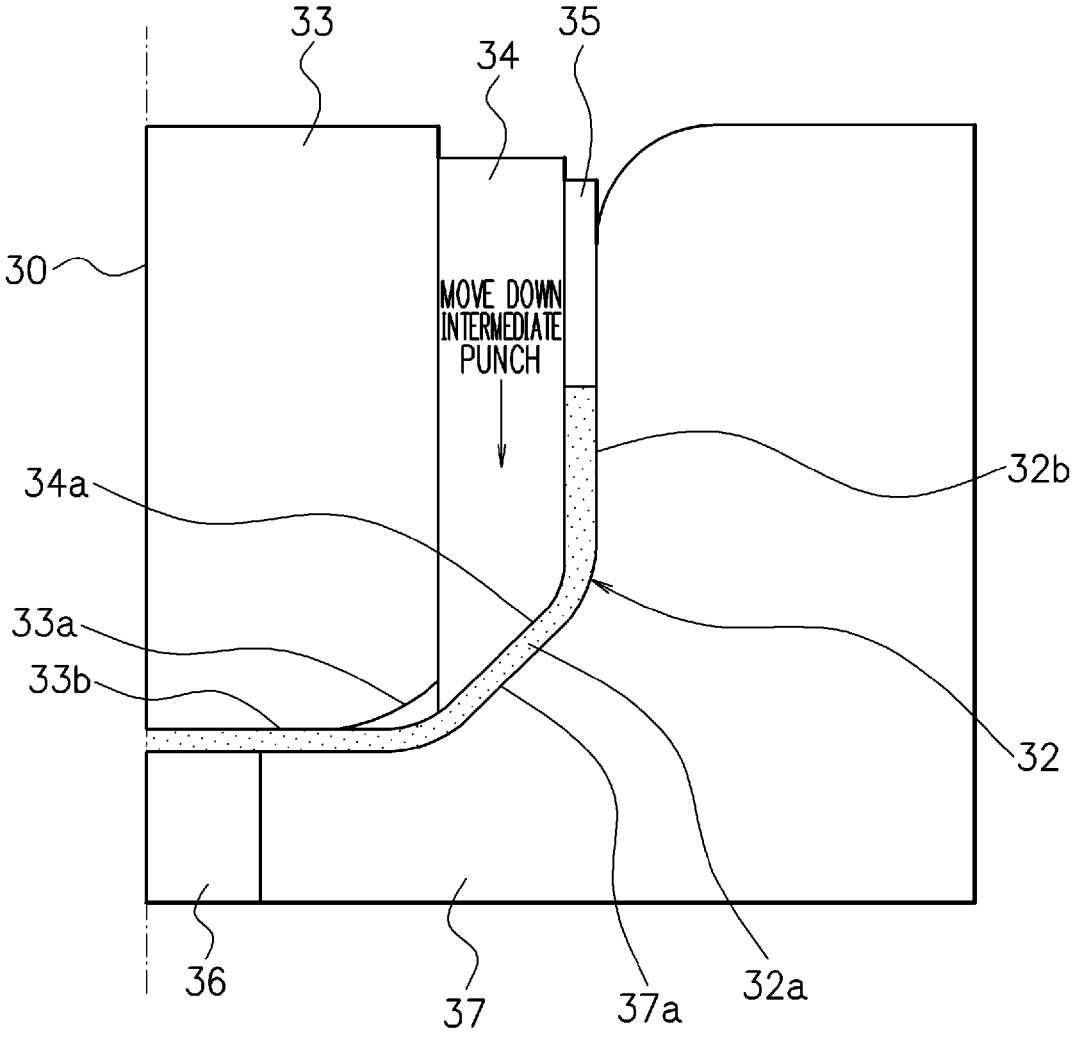
FIG. 9 is a cross-sectional view illustrating a state where an inclined portion of an intermediate punch is brought into contact with the inclined portion of the bottomed container in the press-work method according to the second embodiment.

Subsequently, the intermediate punch 34 is moved downward toward the bottomed container 32 which is brought into contact with the die 37 in the outer punch pressing step (the intermediate punch 34 is pressed toward the die 37), whereby the intermediate punch inclined portion 34*a* is brought into contact with the bottomed container inclined portion 32*a* as illustrated in FIG. 9 (intermediate punch pressing step).

Figure 10:
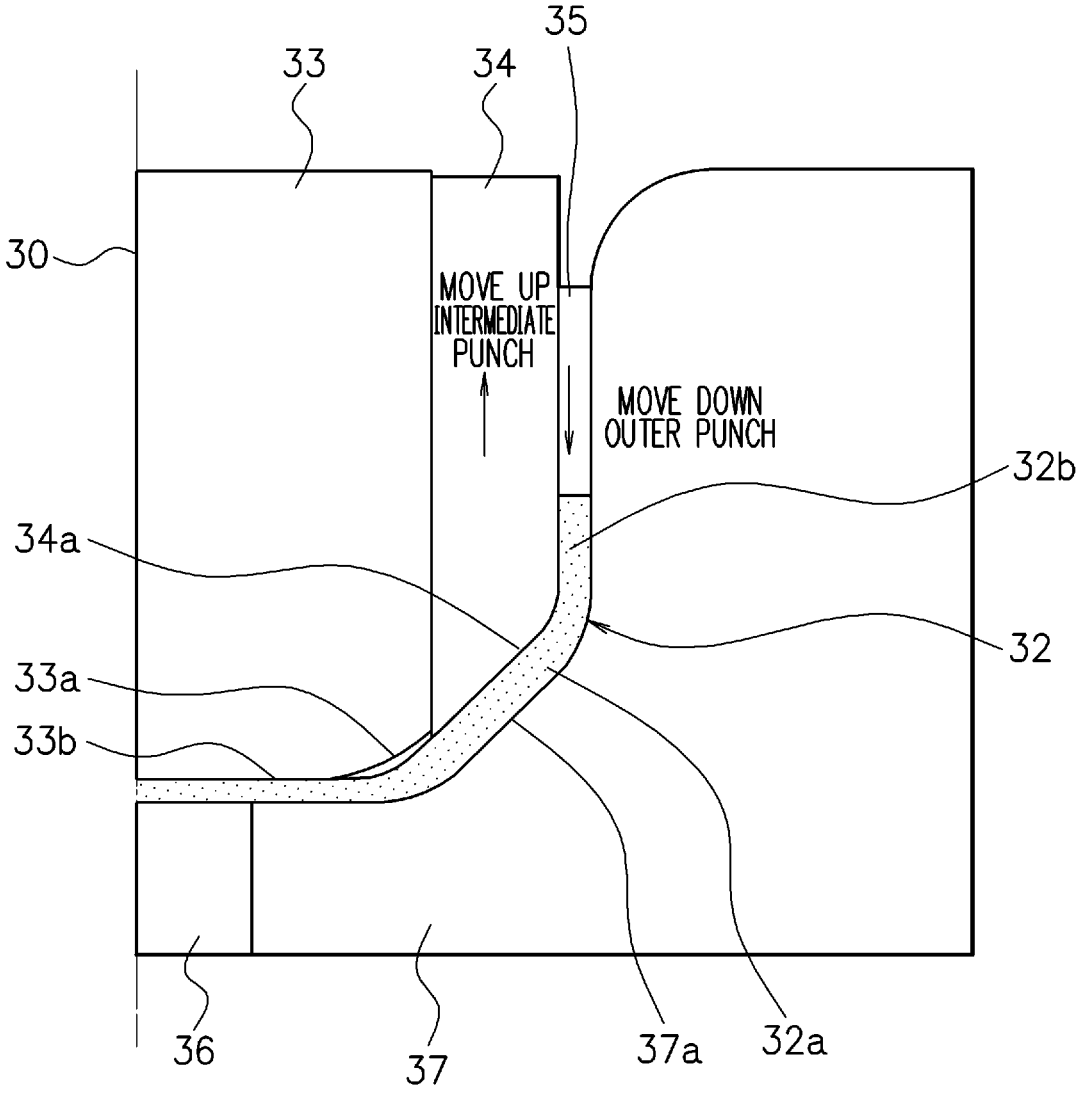
FIG. 10 is a cross-sectional view illustrating a state in the middle of thickening in the press-work method according to the second embodiment.
Figure 11:
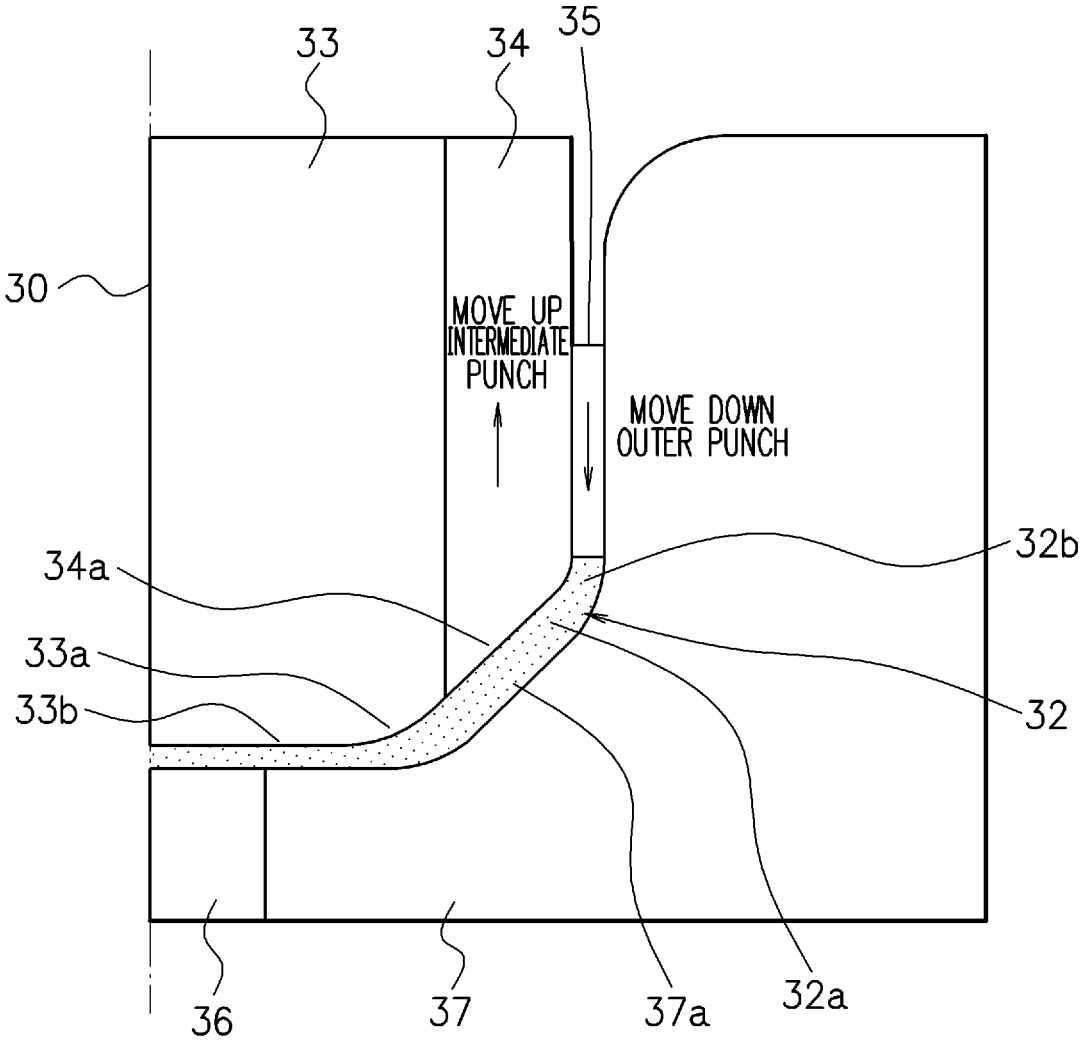
FIG. 11 is a cross-sectional view illustrating a state after the thickening in the press-work method according to the second embodiment.

Subsequently, as illustrated in FIG. 10 and FIG. 11, an end surface of the bottomed container 32 is pressed by the outer punch 35, and the intermediate punch 34 is moved upward. Consequently, a gap between the intermediate punch inclined portion 34*a* and the die inclined portion 37*a* gradually becomes larger, which makes it possible to perform the thickening while suppressing buckling by sandwiching the bottomed container inclined portion 32*a* by the intermediate punch inclined portion 34*a* and the die inclined portion 37*a* (thickening step). The cross-sectional views in FIG. 10 and FIG. 11 illustrate states in the middle of the thickening and after the thickening respectively.

After the thickening step, the inner punch 33, the intermediate punch 34, the outer punch 35, and the knockout 36 are moved upward, and the bottomed container 32 is detached from the die 37. A sheet thickness of the bottomed container inclined portion 32*a* is 8 mm, and thus the thickness can be increased to twice an original sheet thickness of 4 mm without any occurrence of folding due to buckling. Further, a smooth shape is achieved without any large step in a boundary between a thickened portion and a non-thickened portion.

Further, at the time of the thickening, a force in a direction perpendicular to the intermediate punch inclined portion 34*a* acts on the intermediate punch 34, but since this force acts in such a direction as to press the intermediate punch 34 against the inner punch 33 (inward in a diameter direction (center direction)), there occurs no gap in a boundary between the inner punch 33 and the intermediate punch 34 and a burr is not generated.

Figure 12:
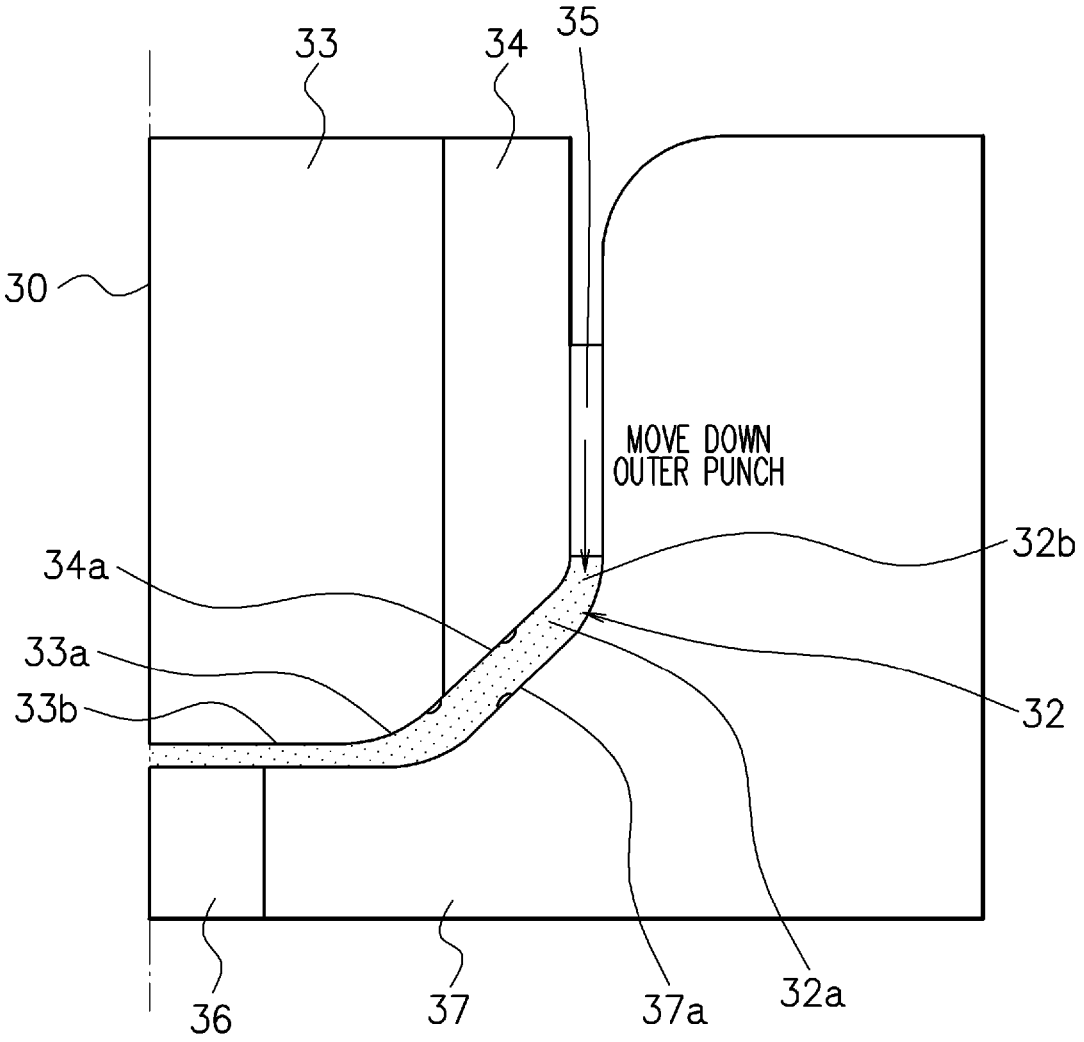
FIG. 12 is a cross-sectional view illustrating a comparative example of the second embodiment.

Here, in the state illustrated in FIG. 7, if the end portion of the bottomed container 32 is pressed by the outer punch 35 without the intermediate punch 34 abutting on the bottomed container 32, the bottomed container inclined portion 32*a* is not sufficiently constrained, and accordingly, buckling occurs in the bottomed container inclined portion 32*a* as illustrated in FIG. 12. Therefore, by executing the thickening process by the outer punch 35 while constraining the bottomed container inclined portion 32*a* by sandwiching it by the intermediate punch 34 and the die 37, it is possible to suppress the buckling in the bottomed container inclined portion 32*a*.

In the above-described examples, an angle made by the bottomed container inclined portions 22*a*, 32*a* and the horizontal direction is 45°, but it is desirably not less than 20° nor more than 70°. This is because, if the angle made by the bottomed container inclined portion 22*a*, 32*a* and the horizontal direction is less than 20°, a flow of a material from bottomed container vertical wall portions 22*b*, 32*b* to the bottomed container inclined portions 22*a*, 32*a* becomes worse, and a load required for the forming becomes large. Further, this is because, if the angle made by the bottomed container inclined portions 22*a*, 32*a* and the horizontal direction is over 70°, a contact length of the workpieces 21, 31 and the mold becomes long, and accordingly a frictional force becomes large, so that a load required for the forming becomes large. Note that the bottomed container vertical wall portions 22*b*, 32*b* mean portions of the bottomed containers 22, 32 on a side closer to the outer punches 25, 35 than the bottomed container inclined portions 22*a*, 32*a*.

Hitherto, the present invention has been described together with various embodiments, but the present invention is not limited only to these embodiments, and changes and so on can be made within the scope of the present invention.

In the above-described examples, SAPH590 is used as the workpiece, but it is not limited to an iron-based material, but an aluminum-based metal, a titanium-based metal, or the like is usable.

Further, in the above-described embodiments, the examples where the bottomed container whose inclined portion is thickened is manufactured from the disk-shaped workpiece by the press-work having one process, but the present invention is also applicable to a press-work whose thickening target is a bottomed container having an inclined portion which is formed in a separate process, that is, to a press-work whose starting state is FIG. 3 or FIG. 7.

INDUSTRIAL APPLICABILITY

The present invention is usable for thickening an inclined portion rising from a bottom surface portion of a bottomed container.

The invention claimed is:

1. A press-work method using a press mold which includes an inner punch, an intermediate punch disposed along an outer periphery of the inner punch and having an intermediate punch inclined portion at a leading end, an outer punch disposed along an outer periphery of the intermediate punch, and a die having a die inclined portion facing the intermediate punch inclined portion, central axes of all of which are disposed coaxially, the method comprising a thickening step of, while constraining a bottom portion of a bottomed container by the inner punch and the die, pressing an end portion of the bottomed container by the outer punch and moving the intermediate punch in a direction opposite a direction in which the outer punch is pressed, to thereby thicken a bottomed container inclined portion of the bottomed container sandwiched by the intermediate punch inclined portion and the die inclined portion.

2. The press-work method according to claim 1, comprising, before the thickening step, a forming step of pressing a disk-shaped workpiece into the die by the inner punch and the intermediate punch to form the bottomed container in which the bottomed container inclined portion is formed at a position sandwiched by the intermediate punch inclined portion and the die inclined portion.

3. A press-work method using a press mold which includes an inner punch having an inner punch flat portion and an inner punch inclined portion at a leading end, an intermediate punch disposed along an outer periphery of the inner punch and having an intermediate punch inclined portion at a leading end, an outer punch disposed along an outer periphery of the intermediate punch, and a die having a die inclined portion disposed to face the intermediate punch inclined portion, central axes of all of which are disposed coaxially, the inner punch inclined portion being formed at an end portion, of the leading end of the inner punch, on a side adjacent to the intermediate punch inclined portion, the method comprising:

an outer punch pressing step of, while constraining a bottom portion of a bottomed container by the inner punch flat portion and the die, pressing an end portion of the bottomed container by the outer punch to thereby bring a bottomed container inclined portion, of the bottomed container, which extends along the inner punch inclined portion and the intermediate punch inclined portion, into contact with the die inclined portion;

an intermediate punch pressing step of pressing the intermediate punch in a direction of the die against the bottomed container which is brought into contact with the die inclined portion in the outer punch pressing step, to bring the intermediate punch inclined portion into contact with the bottomed container inclined portion; and a thickening step of pressing the outer punch against the bottomed container which is brought into contact with the intermediate punch inclined portion in the intermediate punch pressing step, and moving the intermediate punch in a direction opposite a direction in which the outer punch is pressed, to thereby thicken the bottomed container inclined portion.

4. The press-work method according to claim 3, comprising, before the outer punch pressing step, a forming step of pressing a disk-shaped workpiece into the die by the inner punch and the intermediate punch to form the bottomed container in which the bottomed container inclined portion is formed at a position sandwiched by the inner punch inclined portion and the intermediate punch inclined portion, and the die inclined portion.

* * * * *